US005103515A

United States Patent [19]

Bird

[11] Patent Number: 5,103,515

[45] Date of Patent: Apr. 14, 1992

[54] BLANKET CONVERTIBLE TO AND FROM A TOTE

[76] Inventor: Joann T. Bird, 50 T-Bird Lane, Superior, Mont. 59872

[21] Appl. No.: 746,224

[22] Filed: Aug. 8, 1991

[51] Int. Cl.[5] ..... A47G 9/06; A45C 9/06

[52] U.S. Cl. ..... 5/420; 5/417; 190/2; 383/15

[58] Field of Search ..... 5/417–420; 190/1, 2, 117; 383/4, 15

[56] References Cited

U.S. PATENT DOCUMENTS

| | | | |
|---|---|---|---|
| 2,030,360 | 2/1936 | Dyer | 190/117 |
| 3,477,552 | 11/1969 | Goldman | 5/420 |
| 4,188,988 | 2/1980 | Agyagos | 5/417 |
| 4,195,378 | 4/1980 | Parker | 5/419 |
| 4,197,891 | 4/1980 | Comollo | 5/417 |
| 4,468,810 | 8/1984 | Longo | 5/417 |
| 4,489,815 | 12/1984 | Martinez et al. | 5/417 |
| 4,592,091 | 5/1986 | Italici | 190/117 |
| 4,789,247 | 12/1988 | Schnoor | 5/417 |

FOREIGN PATENT DOCUMENTS

| | | | |
|---|---|---|---|
| 819449 | 10/1951 | Fed. Rep. of Germany | 5/417 |

*Primary Examiner*—Alexander Grosz
*Attorney, Agent, or Firm*—Jerry D. Guenther

[57] ABSTRACT

A lightweight blanket with insulating properties being made of a sheet of pliable material and having a number of internal pockets, is convertible to and from a tote by folding portions of the sheet over and upon one another about transverse and longitudinal folds. Carrying handles are positioned in registry with one another and fastened together after folding the sheet portions and used as a convenient grip for carrying the tote.

3 Claims, 2 Drawing Sheets

BLANKET CONVERTIBLE TO AND FROM A TOTE

BACKGROUND OF THE INVENTION

1. Field of the Invention

This invention generally relates to blankets convertible into totes and particularly to blankets which are converted into such totes by folding and, more particularly, a method for converting such a blanket to and from a tote for conveniently carrying articles.

2. Description of Related Art

Blankets which convert into totes are known. There are occasions when children or adults wish to be lying on or covered by a quilt or blanket or the like. These people may desire to carry items to the place of leisure or other activity. There are a variety of situations wherein there are space constraints which limit the ability of an individual to conveniently transport items necessary to engage in activities to the site where such activities are to take place. For example, for lounging, camping, picnicking, and other related activities, it is desirable to have a surface on which an individual may rest that will protect the individual from a rough and uneven surface and which will assist in thermally insulating the user. Typically, a blanket, or similar article, is used for such functions. However, a blanket is necessarily a further separate article to be transported with other paraphernalia associated with the activities, thus presenting additional space and transportation burdens.

As another example, the care of an infant child often requires the carrying of various paraphernalia necessary for the child when away from the ordinary conveniences of home. For instance, a blanket or other bedding is desirable so the child may comfortably nap. A blanket or bedding is necessarily a further separate article which must be transported with other paraphernalia associated with the child's care thereby presenting additional space and transportation burdens.

An advantage of convertible blankets/totes is the ease of the additional space and transportation burdens and the further convenience in undertaking activities. Thus what is needed is a multipurpose convertible blanket/tote with internal pockets which is durable and easily converted from a blanket to a tote.

A number of inventions have been patented for a blanket/bag combination, as exemplified by U.S. Pat. Nos. 4,991,245 to Franco which describes a portable pillow/lounge set convertible to and from a tote bag, and method of folding which forms internal article-holding compartments; U.S. Pat. No. 4,984,906 to Little which describes a multi-purpose t-shaped utility tote with zipper disposed about the perimeter; U.S. Pat. No. 4,789,247 to Schnoor which describes a beach blanket convertible to tote bag by making two folds and being held by a drawstring; U.S. Pat. No. 4,738,545 to Westgor which describes a combination mat and carrying bag with periphery drawstring casing forming a handle and involving no folding; U.S. Pat. No. 4,703,528 to Rolle which describes a ground cover with hidden pockets and weighted corners; U.S. Pat. No. 4,489,815 to Martinez et al. which describes a three layer carrying bag or box that provides for a semi-rigid surface; U.S. Pat. No. 4,195,378 to Parker which describes an oversize heavy duty beach towel with sealable pockets at one end and removable handle; U.S. Pat. No. 4,188,988 to Agyagos which describes a sheet assembly for use as a multipurpose tote bag including 2 layers of waterproof material partially sewn together with unsewn opening at top and two pairs of fastener attachments sewn in parallel along the vertical axes and extending from the bottom to the top opening of the tote bag for retaining the shape of the tote after folding; U.S. Pat. No. 3,514,796 to Dibrell which describes bedclothes; U.S. Pat. No. 3,143,748 to Manning which describes combination container and cushion; U.S. Pat. No. 2,344,010 to Walsh which describes a combination beach robe, towel and receptacle; U.S. Pat. No. 1,102,200 to Miller which describes a camp-pack; U.S. Pat. No. 748,288 to Klein which describes a convertible knapsack, hammock and sleeping bag; U.S. Pat. No. 41,870 to Sus which describes a tent with pocket and shoulder straps; U.S. Pat. No. 41,418 to Abbott which describes a knapsack, hammock and tent; and U.S. Pat. No. 33,385 to Frodsham & Levett which describes a combination knapsack and bed.

The present invention constitutes an improvement over previous blanket/totes and methods of converting the same. What was needed was a blanket convertible into a tote which was lightweight, compact, capable of carrying paraphernalia, and easily converted from a blanket into a tote or vice versa. The blanket provides a lightweight, warm cover with pockets. The tote provides compact carrying and storage capabilities. The present invention is quite simple, has no handles or other portions which impinge upon the interior of the unit when it is used as a blanket and is easy to convert from a blanket to a tote or vice versa.

SUMMARY OF THE INVENTION

1. Objects of the Invention

It is a general object of my invention to convert a lightweight blanket with insulating properties into a tote bag for convenient carrying of paraphernalia.

It is another object of my invention to provide such a convertible blanket/tote bag.

It is another object of my invention to save the inconvenience and annoyance of carrying multiple bags loaded with paraphernalia to and from activities.

It is another object of my invention to provide a lightweight blanket designed for greater warmth and comfort.

It is another object of my invention to provide a tote with pockets of sufficient size to adequately hold such articles as toys, books, clothing, lunches, snacks.

It is another object of my invention to provide a lap cover to provide lightweight warmth and stowing of accoutrements by infants, elderly persons, invalids, travelers, outdoor sports fans, and high school students on bus trips.

2. Features of the Invention

In keeping with these objects, and others which will become apparent hereinafter, specifically, my invention provides a lightweight blanket with insulating properties convertible into a tote comprising a sheet of pliable material having a first outer layer of woven material, a second outer layer of woven material, and a layer of insulating material secured between the first and second outer layers of woven material and bound with seam binding on a first longitudinally parallel side edge and a second longitudinally parallel side edge and a first transversely parallel end edge and a second transversely parallel end edge with the side edges being approximately one-third longer than and generally perpendicular to the end edges. The sheet has a generally rectangular shape.

The sheet of pliable material has a first sealable pocket at the first transversely parallel end edge. The first sealable pocket is constructed between the first and second outer layers and extends in the longitudinal direction of the longitudinally parallel side edges for a distance of one-third the longitudinal length of the longitudinally parallel side edges commencing on the first transversely parallel end edge. The first sealable pocket extends in the transverse direction of the first transversely parallel end edge for a distance of one-half the transverse width of the first transversely parallel end edge commencing on a longitudinal axis parallel with the longitudinally parallel side edges located one-fourth of the transverse width of the first transversely parallel end edge from the first longitudinally parallel side edge and terminating on a longitudinal axis parallel with the longitudinally parallel side edges located one-fourth of the transverse width of the first transversely parallel end edge from the second longitudinally parallel side edge.

The sheet of pliable material has a second sealable pocket at the second transversely parallel end edge. The second sealable pocket is constructed between the first and second outer layers and extends in the longitudinal direction of the longitudinally parallel side edges for a distance of one-third the longitudinal length of the longitudinally parallel side edges commencing on the second transversely parallel end edge. The second sealable pocket extends in the transverse direction of the second transversely parallel end edge for a distance of one-fourth the transverse width of the second transversely parallel end edge commencing on the first longitudinally parallel side edge and terminating on a longitudinal axis parallel with the longitudinally parallel side edges located one-fourth of the transverse width of the second transversely parallel end edge from the first longitudinally parallel side edge.

The sheet of pliable material has a third sealable pocket at the second transversely parallel end edge. The third sealable pocket is constructed between the first and second outer layers and extends in the longitudinal direction of the longitudinally parallel side edges for a distance of one-third the longitudinal length of the longitudinally parallel side edges commencing on the second transversely parallel end edge. The third sealable pocket extends in the transverse direction of the second transversely parallel end edge for a distance of one-fourth the transverse width of the second transversely parallel end edge, commencing on the second longitudinally parallel side edge and terminating on a longitudinal axis parallel with the longitudinally parallel side edges located one-fourth of the transverse width of the second transversely parallel end edge from the second longitudinally parallel side edge.

The sheet of pliable material has a first carrying strap which attaches along a first transverse axis which extends between the first and second longitudinally parallel side edges. The first transverse axis is located at a position one-third the longitudinal length of the longitudinally parallel side edges from the first transversely parallel end edge. The first carrying strap attaches at the first longitudinally parallel side edge and lays in a first sewn channel between the first and second outer layers for a transverse width of one-fourth of the first transverse axis along the first transverse axis commencing on the first longitudinally parallel side edge. The first sewn channel consists of two parallel seams sewn through the first and second outer layers along the first transverse axis which forms a channel between the first and second outer layers in which the first carrying strap freely lays. The first carrying strap passes through a first eyelet which extends through the first outer layer to abut the exterior of the first outer layer for a transverse width of one-half of the first transverse axis. The first carrying strap attaches to the first outer layer by complimentary pairs of fastener means one half of each of which complimentary pairs are located respectively on the abutting surfaces of the first carrying strap and the first outer layer along the first transverse axis. The first carrying strap passes through a second eyelet which extends through the first outer layer to a second sewn channel between the first and second outer layers. The first carrying strap lays in the second sewn channel for a transverse width of one-fourth of the first transverse axis and attaches to and terminates at the second longitudinally parallel side edge. The second sewn channel consists of two parallel seams sewn through the first and second outer layers along the first transverse axis which form a channel between the first and second outer layers in which the first carrying strap freely lays.

The sheet of pliable material has a second carrying strap which is parallel to the first carrying strap and attaches along a second transverse axis parallel to the first transverse axis which extends between the first and second longitudinally parallel side edges. The second transverse axis is located at a position one-third the longitudinal length of the longitudinally parallel side edges from the second transversely parallel end edge. The second carrying strap attaches at the first longitudinally parallel side edge and lays in a third sewn channel between the first and second outer layers for a transverse width of one-fourth of the second transverse axis along the second transverse axis commencing on the first longitudinally parallel side edge. The third sewn channel consists of two parallel seams sewn through the first and second outer layers along the second transverse axis which form a channel between the first and second outer layers in which the second carrying strap lays. The second carrying strap passes through a third eyelet which extends through the first outer layer to abut the exterior of the first outer surface for a transverse width of one-half the second transverse axis. The second carrying strap attaches to the first outer surface by complimentary pairs of fastener means one half of each of which complimentary pairs are located respectively on the abutting surfaces of the second carrying strap and the first outer layer along the second transverse axis. The complimentary pairs of fastener means located on the first carrying strap and first transverse axis are located complimentary but inverse to the complimentary pairs of fastener means located on the second carrying strap and second transverse axis so that one half of the respective complimentary fastener means of the first and second carrying straps are complimentary and attach to each other when the blanket is folded into a tote and the first and second carrying straps are in registry with each other. The second carrying strap passes through a fourth eyelet which extends through the first outer layer to a fourth sewn channel between the first and second outer layers. The second carrying strap lays in the fourth sewn channel for a transverse width of one-fourth of the second transverse axis and attaches to and terminates at the second longitudinally parallel side edge. The fourth sewn channel consists of two parallel seams sewn through the first and second outer layers along the second transverse axis which forms a channel between the first and second outer layers in which the second carrying strap lays.

The blanket can be conveniently and rapidly converted into a tote which can be used for the convenient hand-carrying of paraphernalia. The three sealable pockets can be used to reduce the number of bags used to carry paraphernalia to an activity. The inconvenience and annoyance of carrying multiple small bags laden with articles is therefore eliminated.

As can be readily inferred from the heretofore stated description of the invention, the method of the invention is directed to converting a blanket to a tote and comprises the steps of:

The sheet of pliable material has short portions foldable over and upon one another about transverse and longitudinal axes respectively parallel to the transverse and longitudinal directions;

Specifically, the longitudinal one-third bordered by the second transverse end edge is folded initially about the second transverse axis;

Thereupon, the longitudinal one-third bordered by the first transverse end edge is folded about the first transverse axis;

The transverse one-fourth bordered by the first longitudinal side edge is folded about the first longitudinal axis;

The transverse one-fourth bordered by the second longitudinal side edge is folded about the second longitudinal axis;

The sheet of pliable material is lastly folded about a third longitudinal axis located one-half the transverse width between the longitudinally parallel side edges to form the tote;

The parallel carrying straps are brought into registry with each other and fastened together with fastening means forming a convenient hand-grip for the tote.

DESCRIPTION OF PREFERRED EMBODIMENTS

Figure 1:
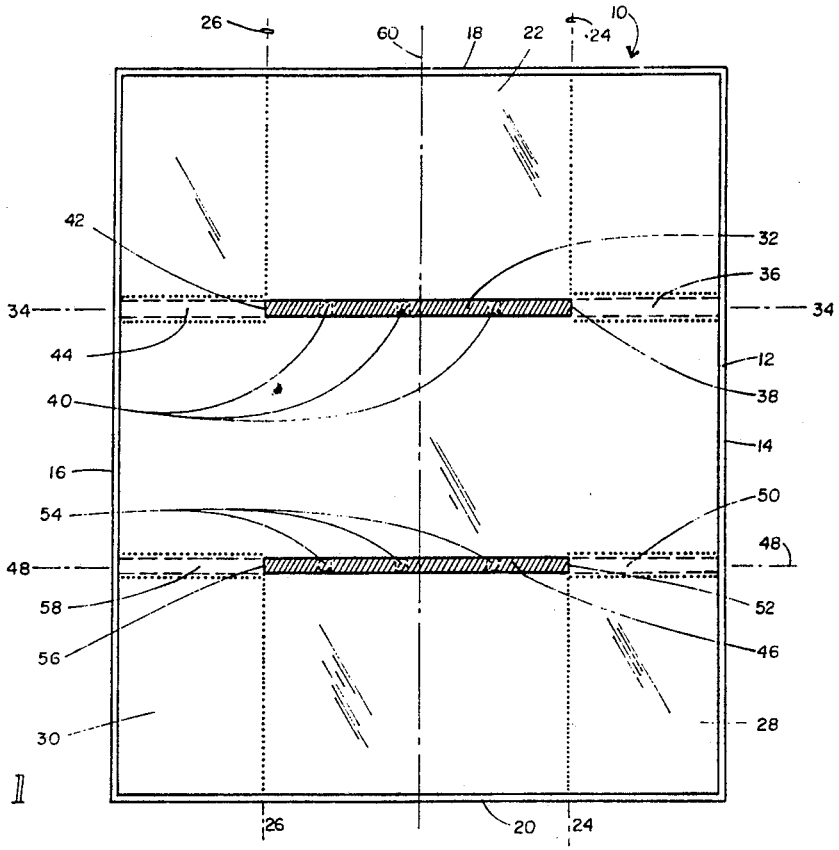
FIG. 1 is a top plan view of the present invention showing the attached carrying straps and sealable pockets.
Figure 2:
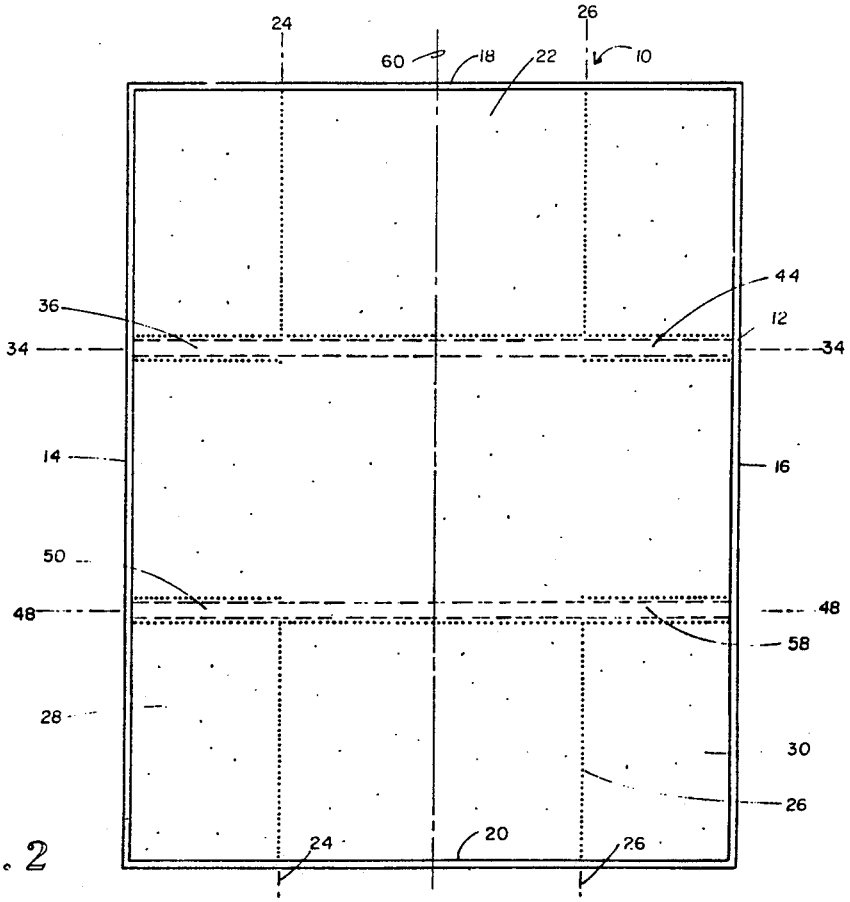
FIG. 2 is a bottom plan view of the present invention.
Figure 3:
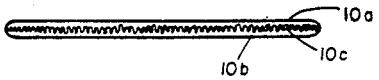
FIG. 3 is a cross-section view of the present invention showing the three layers of the sheet.

Referring now to FIGS. 1, 2 and 3 of the drawings, the blanket comprises a sheet of pliable material 10 having a first outer layer of woven material 10*a*, a second outer layer of woven material 10*b*, and a layer of insulating material 10*c* secured between the first and second outer layers 10*a*, 10*b* and bound with seam binding 12 on a first longitudinally parallel side edge 14 and a second longitudinally parallel side edge 16 and on a first transversely parallel end edge 18 and a second transversely parallel end edge 20 with the side edges 14, 16 being one-third longer than and generally perpendicular to the end edges 18, 20. The sheet has a generally rectangular shape as seen in plan view.

The sheet of pliable material 10 has a first sealable pocket 22 at the first transversely parallel end edge 18. The first sealable pocket 22 is constructed between the first and second outer layers 10*a*, 10*b* and extends in the longitudinal direction of the longitudinally parallel side edges 14, 16 for a distance of one-third the longitudinal length of the longitudinally parallel side edges 14, 16 commencing on the first transversely parallel end edge 18. The first sealable pocket 22 extends in the transverse direction of the first transversely parallel end edge 18, for a distance of one-half the transverse width of the first transversely parallel end edge 18 commencing on a longitudinal axis 24 parallel with the longitudinally parallel side edges 14, 16 located one-fourth of the transverse width of the first transversely parallel end edge 18 from the first longitudinally parallel side edge 14 and terminating on a longitudinal axis 26 parallel with the longitudinally parallel side edges 14, 16 located one-fourth of the transverse width of the first transversely parallel end edge 18 from the second longitudinally parallel side edge 16.

The sheet of pliable material 10 has a second sealable pocket 28 at the second transversely parallel end edge 20. The second sealable pocket 28 is constructed between the first and second outer layers 10*a*, 10*b* and extends in the longitudinal direction of the longitudinally parallel side edges 14, 16 for a distance of one-third the longitudinal length of the longitudinally parallel side edges 14, 16 commencing on the second transversely parallel end edge 20. The second sealable pocket 28 extends in the transverse direction of the second transversely parallel end edge 20 for a distance of one-fourth the transverse width of the second transversely parallel end edge 20 commencing on the first longitudinally parallel side edge 14 and terminating on the longitudinal axis 24 parallel with the longitudinally parallel side edges 14, 16 located one-fourth of the transverse width of the second transversely parallel end edge 20 from the first longitudinally parallel side edge 14.

The sheet of pliable material 10 has a third sealable pocket 30 at the second transversely parallel end edge 20. The third sealable pocket 30 is constructed between the first and second outer layers 10*a*, 10*b* and extends in the longitudinal direction of the longitudinally parallel side edges 14, 16 for a distance of one-third the longitudinal length of the longitudinally parallel side edges 14, 16 commencing on the second transversely parallel end edge 20. The third sealable pocket 30 extends in the transverse direction of the second transversely parallel end edge 20 for a distance of one-fourth the transverse width of the second transversely parallel end edge 20 commencing on the second longitudinally parallel side edge 16 and terminating on the longitudinal axis 26 parallel with the longitudinally parallel side edges 14, 16 located one-fourth of the transverse width of the second transversely parallel end edge 20 from the second longitudinally parallel side edge 16.

The sheet of pliable material 10 has a first carrying strap 32 which attaches along a first transverse axis 34 which extends between the first and second longitudinally parallel side edges 14, 16. The first transverse axis 34 is located at a position one-third the longitudinal length of the longitudinally parallel side edges 14, 16 from the first transversely parallel end edge 18. The first carrying strap 32 attaches at the first longitudinally parallel side edge 14 and lays in a first sewn channel 36 between the first and second outer layers 10*a*, 10*b* for a transverse width of one-fourth of the first transverse axis 34 along the first transverse axis commencing on the first longitudinally parallel side edge 14. The first sewn channel 36 consists of two parallel seams sewn through the first and second outer layers 10*a*, 10*b* along the first transverse axis 34 which forms a channel between the first and second outer layers 10*a*, 10*b* in which the first carrying strap 32 freely lays. The first carrying strap 32 passes through a first eyelet 38 which extends through the first outer layer 10*a* to abut the exterior of the first outer layer 10*a* for a transverse width of one-half of the first transverse axis 34. The first carrying strap 32 attaches to the first outer layer 10*a* by complimentary pairs of fastener means 40 one half of each of which complimentary pairs 40 are located respectively on the abutting surfaces of the first carrying strap 32 and the first outer layer 10*a* along the first transverse axis 34. The first carrying strap 32 passes through a second eyelet 42 which extends through the first outer layer 10*a* to a second sewn channel 44 between the first and second outer layers 10*a*, 10*b*. The first carrying strap 32 lays in the second sewn channel 44 for a transverse width of one-fourth the first transverse axis 34 and attaches to and terminates at the second longitudinally parallel side edge 16. The second sewn channel 44 consists of two parallel seams sewn through the first and second outer layers 10*a*, 10*b* along the first transverse axis 34 which forms a channel between the first and second outer layers 10*a*, 10*b* in which the first carrying strap 32 freely lays.

The sheet of pliable material 10 has a second carrying strap 46 which is parallel to the first carrying strap 32 and attaches along a second transverse axis 48 parallel to the first transverse axis 34 which extends between the first and second longitudinally parallel side edges 14, 16. The second transverse axis 48 is located at a position one-third the longitudinal length of the longitudinally parallel side edges 14, 16 from the second transversely parallel end edge 20. The second carrying strap 46 attaches at the first longitudinally parallel side edge 14 and lays in a third sewn channel 50 between the first and second outer layers 10*a*, 10*b* for a transverse width of one-fourth of the second transverse axis 48 along the second transverse axis commencing on the first longitudinally parallel side edge 14. The third sewn channel 50 consists of two parallel seams sewn through the first and second outer layers 10*a*, 10*b* along the second transverse axis 48 which forms a channel between the first and second outer layers 10*a*, 10*b* in which the second carrying strap 46 lays. The second carrying strap 46 passes through a third eyelet 52 which extends through the first outer layer 10*a* and abuts the exterior of the first outer layer 10*a* for a transverse width of one-half of the second transverse axis 48. The second carrying strap 46 attaches to the first outer layer 10*a* by complimentary pairs of fastener means 54, one half of each of which complimentary pairs are located respectively on the abutting surfaces of the second carrying strap 46 and the first outer layer 10*a* along the second transverse axis 48. The complimentary pairs of fastener means 40 located on the first carrying strap 32 and first transverse axis 34 are located complimentary but inverse to the complimentary pairs of fastener means 54 located on the second carrying strap 46 and second transverse axis 48 so that one half of the respective complimentary fastener means of the first and second carrying straps are complimentary and attach to each other when the blanket is folded into a tote and the first and second carrying straps are in registry with each other. The second carrying strap 46 passes through a fourth eyelet 56 which extends through the first outer layer 10*a* to a fourth sewn channel 58 between the first and second outer layers 10*a*, 10*b*. The second carrying strap 46 lays in the fourth sewn channel 58 for a transverse width of one-fourth of the second transverse axis 48 and attaches to and terminates at the second longitudinally parallel side edge 16. The fourth sewn channel 58 consists of two parallel seams sewn through the first and second outer layers 10*a*, 10*b* along the second transverse axis 48 which forms a channel between the first and second outer layers 10*a*, 10*b* in which the second carrying strap 46 lays.

Figure 4:
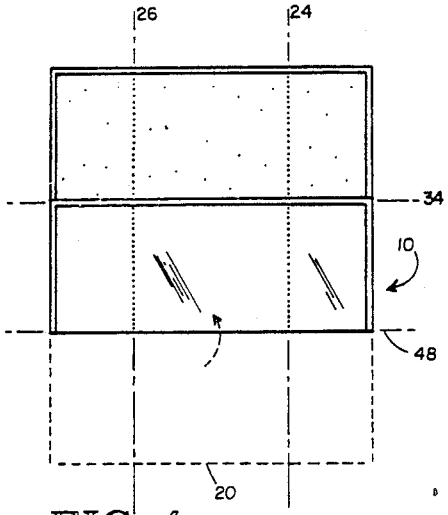
FIG. 4 is a view analogous to FIG. 2, but showing the blanket after having been folded once about a transverse axis.
Figure 5:
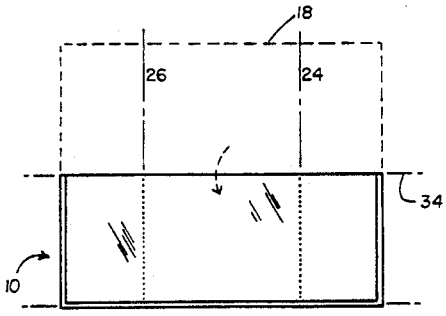
FIG. 5 is a view analogous to FIG. 2, but showing the blanket after having been folded a second time about a second transverse axis.
Figure 6:
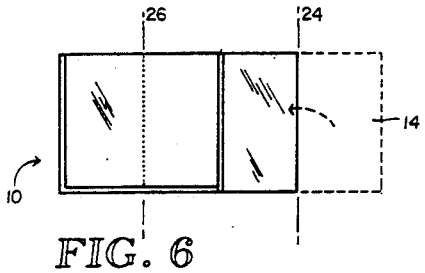
FIG. 6 is a view analogous to FIG. 2, but showing the blanket after having been folded once about a longitudinal axis.
Figure 7:
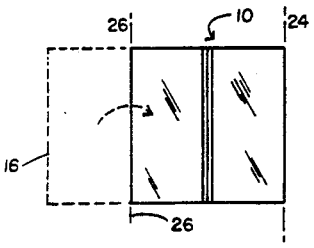
FIG. 7 is a view analogous to FIG. 2, but showing the blanket after having been folded a second time about a second longitudinal axis.
Figure 8:
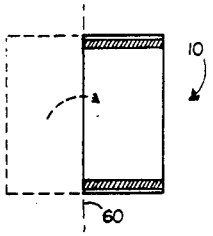
FIG. 8 is a view analogous to FIG. 2, but showing the blanket after having been folded a third time about a third longitudinal axis.
Figure 9:
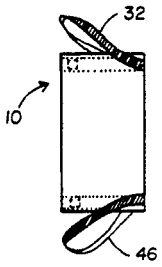
FIG. 9 is a perspective of the tote formed from the embodiment of FIG. 1.
Figure 10:
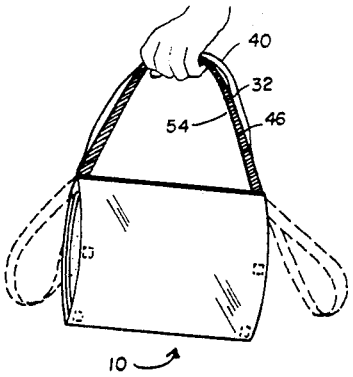
FIG. 10 is a perspective of the tote showing the carrying straps.

Concentrating on the method of the invention, turning to FIGS. 4 through 10, the sheet of pliable material 10, has short portions foldable over and upon one another about transverse 34, 48 and longitudinal 24, 26 axes respectively parallel to the transverse and longitudinal directions. Specifically, the longitudinal one-third bordered by the second transverse end edge 20 is folded initially about the second transverse axis 48 (FIG. 4). Thereupon the longitudinal one-third bordered by the first transverse end edge 18 is folded about the first transverse axis 34 (FIG. 5). The transverse one-fourth bordered by the first longitudinal side edge 14 is folded about the first longitudinal axis 24 located one-fourth of the transverse width from the first longitudinally parallel side edge 14 (FIG. 6). The transverse one-fourth bordered by the second longitudinal side edge 16 is folded about the second longitudinal axis 26 located one-fourth the transverse width between longitudinally parallel side edges 14, 16 from the second longitudinally parallel side edge 16 (FIG. 7). The sheet of pliable material 10 is lastly folded to form the tote about a third longitudinal axis 60 located one-half the transverse width between longitudinally parallel side edges 14, 16 (FIG. 8). The parallel carrying straps 32, 46 are brought into registry with each other and can be fastened together with fastener means, 40, 54 forming a convenient hand-grip for the tote (FIG.'S 9 and 10).

It will be understood that each of the elements described above, or two or more together, also may find a useful application in other types of constructions differing from the types described above. While the invention has been illustrated and described as embodied in a blanket convertible to and from a tote bag, and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fully constitute essential characteristics of the general or specific aspects of this invention and, therefore, such adaptations should and are intended to be comprehended within the meaning and range of equivalence of the following claims.

What is claimed is:

1. A blanket convertible to and from a tote comprising:

(a) a sheet of pliable material defining a blanket, the sheet having a first outer layer of woven material, a second outer layer of woven material, and a layer of insulating material secured between the first and second outer layers which are bound on the edges with seam binding, a generally rectangular periphery defined by a first longitudinally parallel side edge and a second longitudinally parallel side edge and a first transversely parallel end edge and a second transversely parallel end edge, the first and second longitudinally parallel side edges being one-third longer than and generally perpendicular to the first and second transversely parallel end edges, the sheet having a first sealable pocket at the first longitudinally parallel end edge, the sheet having a second sealable pocket at the second transversely parallel end edge, the sheet having a third sealable pocket at the second transversely parallel end edge, the sheet having a first parallel carrying strap, the sheet having a second carrying strap, and the sheet having a plurality of fastener means;

(b) the first sealable pocket constructed between the first and second outer layers extending in the longitudinal direction of the longitudinally parallel side edges for a distance of one-third the longitudinal length of the longitudinally parallel side edges from the first transversely parallel end edge, the first sealable pocket extending along the first transversely parallel end edge for a distance of one-half the transverse width between the first and second longitudinally parallel side edges, commencing on a longitudinal axis parallel with the longitudinally parallel side edges located one fourth of the transverse width of the first transversely parallel end edge from the first .longitudinally parallel side edge and terminating on a longitudinal axis parallel with the longitudinally parallel side edges located one-fourth of the transverse width of the first transversely parallel end edge from the second longitudinally parallel side edge;

(c) the second sealable pocket constructed between the first and second outer layers extending in the longitudinal direction of the longitudinally parallel side edges for a distance of one-third the longitudinal length of the longitudinally parallel side edges from the second transversely parallel end edge, the second sealable pocket extending in the transverse direction of the second transversely parallel end edge for a distance of one-fourth the transverse width between the first and second longitudinally parallel side edges, commencing on the first longitudinally parallel side edge and terminating on a line parallel with the longitudinally parallel side edges located one-fourth of the transverse width of the second transversely parallel end edge between the first and second longitudinally parallel side edges from the first longitudinally parallel side edge;

(d) the third sealable pocket constructed between the first and second outer layers extending in the direction of the longitudinally parallel side edges for a distance of one-third the longitudinal length of the longitudinally parallel side edges from the second transversely parallel end edge, the third sealable pocket extending in the transverse direction of the second transversely parallel end edge for a distance of one-fourth the transverse width between the first and second longitudinally parallel side edges, commencing on the second longitudinally parallel side edge and terminating on a line parallel with the longitudinally parallel side edges located one-fourth of the width of the second transversely parallel end edge between the first and second longitudinally parallel side edges from the second longitudinally parallel side edge;

(e) the first carrying strap attaching along a first transverse axis extending between the first and second longitudinally parallel side edges, the first transverse axis located at a position one-third the longitudinal length of the longitudinally parallel side edges from the first transversely parallel end edge, the first carrying strap attaching to and commencing at the first longitudinally parallel side edge and laying in a first sewn channel between the first and second outer layers for a transverse width of one-fourth of the first transverse axis from the first longitudinally parallel side edge, the first sewn channel consisting of two parallel seams sewn through the first and second outer layers along the first transverse axis forming a channel between the first and second outer layers in which the first carrying strap freely lays, the first parallel carrying strap passing through a first eyelet extending through the first outer layer to abut the first outer layer for a transverse width of one-half the length of the first transverse axis and attaching to the first outer layer by complimentary pairs of fastener means, one half of each of which complimentary pairs are located respectively on the abutting surfaces of the first carrying strap and the first outer layer along the first transverse axis, the first carrying strap passing through a second eyelet extending through the first outer layer to a second sewn channel between the first and second layers, the first carrying strap freely laying in the second sewn channel for a transverse width of one-fourth the first transverse axis and attaching to and terminating at the second longitudinally parallel side edge, the second sewn channel consisting of two parallel seams sewn through the first and second outer layers along the first transverse axis forming a channel between the first and second outer layers in which the first carrying strap freely lays;

(f) the second carrying strap parallel to the first carrying strap attaching along a second transverse axis parallel to the first transverse axis extending between the first and second longitudinally parallel side edges, the second transverse axis located at a position one-third the longitudinal length of the longitudinally parallel side edges from the second transversely parallel end edge, the second carrying strap attaching to and commencing at the first longitudinally parallel side edge and laying in a third sewn channel between the first and second outer layers for a transverse width of one-fourth of the second transverse axis from the first longitudinally parallel side edge, the third sewn channel consisting of two parallel seams sewn through the first and second outer layers along the second transverse axis forming a channel between the first and second outer layers in which the second carrying strap lays, the second carrying strap passing through a third eyelet extending through the first outer layer to abut the first outer layer of the sheet for a transverse width of one-half the length of the second transverse axis and attaching to the first outer layer by complimentary pairs of fastener means, one half of each of which complimentary pairs are located respectively on the abutting surfaces of the second carrying strap and the first outer layer along the second transverse axis, the complimentary pairs of fastener means located on the first carrying strap and first transverse axis are located complimentary but inverse to the complimentary pairs of fastener means located on the second carrying strap and second transverse axis so that the one-half of the respective complimentary fastener means of the first and second carrying straps are complimentary and attach to each other when the blanket is folded into a tote and the first and second carrying straps are in registry with each other, the second carrying strap passing through a fourth eyelet extending through the first outer layer to a fourth sewn channel between the first and second layers, the second carrying strap laying in the fourth sewn channel between the first and second layers for a transverse width of one-fourth of the second transverse axis and attaching to and terminating at the second longitudinally parallel side edge, the fourth sewn channel consisting of two parallel seams sewn through the first and second outer layers along the second transverse axis forming a channel between the first and second outer layers in which the second carrying strap lays;

(g) the sheet of pliable material being foldable about transverse and longitudinal folds respectively parallel to the transverse and longitudinal directions to form a tote; and (h) the carrying straps being positioned in registry with each other after folding and attached by complimentary fastener means to form a convenient grip.

2. The invention as defined in claim 1, wherein the sheet of pliable material has a generally rectangular periphery.

3. The invention as defined in claim 1, further comprising means for releasably fastening the carrying straps together after folding.

* * * * *